US005198829A

United States Patent [19]

Marshall

[11] Patent Number: 5,198,829

[45] Date of Patent: Mar. 30, 1993

[54] ANTENNA ROD WITH REMOVABLY MOUNTED SUCTION CUPS

[76] Inventor: Greg Marshall, 5779 Haleola St., Honolulu, Hi. 96821

[21] Appl. No.: 788,857

[22] Filed: Nov. 7, 1991

[51] Int. Cl.[5] ..... H01Q 1/12
[52] U.S. Cl. ..... 343/878
[58] Field of Search ..... 343/715, 878, 888, 900

[56] References Cited

FOREIGN PATENT DOCUMENTS 1112214 3/1956 France ..... 343/878
23242 2/1977 Japan ..... 343/878

*Primary Examiner*—Michael C. Wimer
*Attorney, Agent, or Firm*—Michael I. Kroll

[57] ABSTRACT

The present invention relates to an improved antenna. The improved antenna includes a rod; a first suction cup; a second suction cup; and connectors for removably mounting the first suction cup and the second suction cup longitudinally to the rod.

1 Claim, 1 Drawing Sheet

ANTENNA ROD WITH REMOVABLY MOUNTED SUCTION CUPS

BACKGROUND OF THE INVENTION

1. Field of the Invention

The present invention relates to an antenna.

More particularly, the present invention relates to an improved antenna.

2. Description of the Prior Art

Numerous innovations for improved antennas have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide an improved antenna that avoids the disadvantages of the prior art.

The suction cups may be attached to the flexible shaft in other ways than limited by the present invention, as is.

Velco or glue pods may be used in lieu of suction cups, if so desired.

In keeping with these objects, and with others which will become apparent hereinafter, one feature of the present invention resides, briefly stated, in an antenna, including a rod; a first suction cup; a second suction cup; and means for removably mounting the first suction cup and the second suction cup longitudinally to the rod.

In accordance with another feature of the present invention, means include a threaded connector.

Another feature of the present invention is that the threaded connector includes an externally threaded male portion and an internally threaded or unthreaded female portion.

Yet another feature of the present invention is that the flexible shaft is molded.

Still another feature of the present invention is that the female portions of the connectors are integrally molded with the rod so that when the rod is removed from the mold the female portions of the connectors ar already fixed in place.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

10—antenna of the present invention
11—rod
12—suction cup of the antenna 10 of the present invention
14—suction cup of the antenna 10 of the present invention
16—metallic connector
18—metallic connector
20—male portion
22—female portion

DETAILED DESCRIPTION OF THE PREFERRED EMBODIMENT

Figure 1:
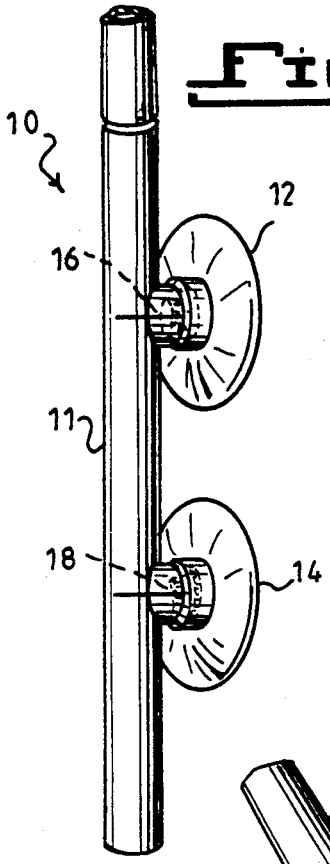
FIG. 1 is a perspective view of the antenna of the present invention.

Referring now to FIG. 1, the antenna of the present invention is shown generally at 10 with a rod 11 and a pair of suction cups 12 and 14 attached to the rod 11. The suction cups 12 and 14 allow the antenna 10 of the present invention to be mounted to a windshield (not shown). Metallic connectors 16 and 18 attach the suction cups 12 and 14 to the rod 11.

Figure 2:
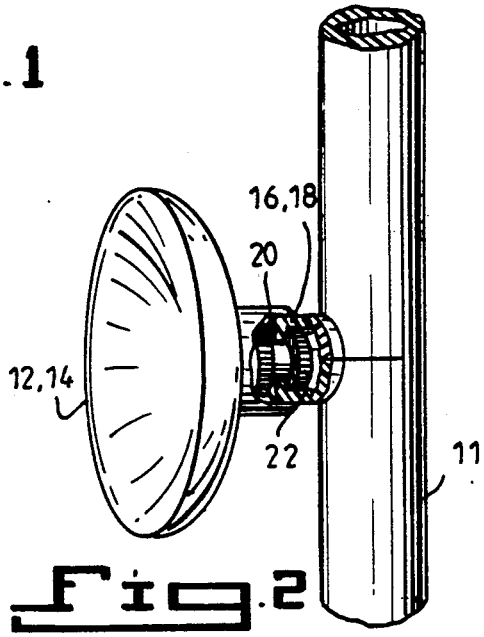
FIG. 2 is a perspective view of the connector holding the suction cup to the rod.
Figure 3:
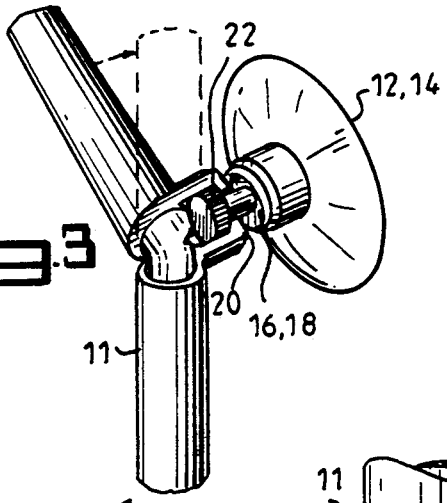
FIG. 3 is a perspective view of the connector with the rod slit and bent out of the way.
Figure 6:
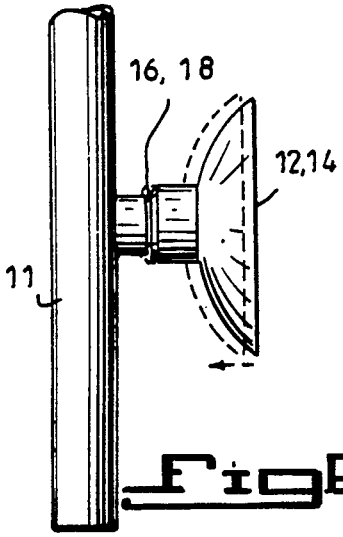
FIG. 6 is a side view showing the suction cup being screwed into the rod.
Figure 4:
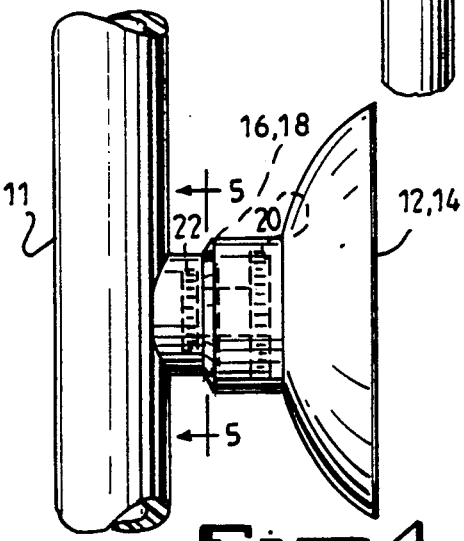
FIG. 4 is a side view of the connector shown in hidden lines.
Figure 5:
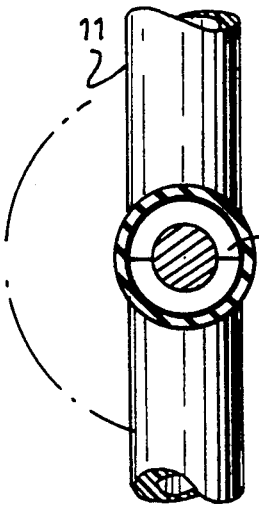
FIG. 5 is a cross sectional view taken along lines 5—5 of FIG. 4 and showing the integral female portion of the connector inside the rod.

As shown in FIGS. 2 through 4, each of the connectors 16 and 18 include two parts, that is, a male portion 20 and a female portion 22. The male portions 20 are part of the suction cups 12 and 14 while the female portions 22 are integral parts that are molded within the rod 11 in one operation when rod 11 is molded, as shown in FIG. 5.

The female portions 22 include internal threads while the male portions 20 include external threads which allow the suction cups 12 and 14 to be screwed onto the rod 11.

It is important to remember that the female portions 22 of the connectors 16, 18 are in place when the rod 11 is molded and therefore becomes an integral part thereof.

It will be understood that each of the elements described above, or two or more together, may also find a useful application in other types of constructions differing from the type described above.

While the invention has been illustrated and described as embodied in an improved antenna, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An antenna, comprising:

a) a totally cylindrically molded rod;

b) a first suction cup;

c) a second suction cup; and d) means for removably mounting said first suction cup and said second suction cup longitudinally to said totally cylindrically molded rod, said means including threaded connectors, said threaded connectors including externally threaded male portions and internally threaded female portions, said female portions of said connectors are integrally molded with said totally cylindrically molded rod forming a homogeneous structure for strength so that when said totally cylindrically molded rod is removed from them old said female portions of said connectors are already fixed in place and cannot be separated from the totally cylindrically molded rod.

* * * * *